US007232291B2

(12) United States Patent
Choi et al.

(10) Patent No.: US 7,232,291 B2
(45) Date of Patent: Jun. 19, 2007

(54) VARIABLE CAPACITY ROTARY COMPRESSOR

(75) Inventors: Jae-Young Choi, Kyungki-Do (KR); Jin Kyu Choi, Kyungki-Do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 759 days.

(21) Appl. No.: 10/671,597

(22) Filed: Sep. 29, 2003

(65) Prior Publication Data

US 2004/0161345 A1 Aug. 19, 2004

(30) Foreign Application Priority Data

Feb. 14, 2003 (KR) ..... 10-2003-0009449

(51) Int. Cl.
*F04B 49/03* (2006.01)
*F04C 18/344* (2006.01)

(52) U.S. Cl. ..... 417/298; 418/63

(58) Field of Classification Search ..... 417/298, 417/557; 418/63

See application file for complete search history.

(56) References Cited

U.S. PATENT DOCUMENTS 4,432,698 A * 2/1984 Shirakuma et al. ..... 417/298
4,558,993 A * 12/1985 Hori et al. ..... 417/299
6,206,652 B1 * 3/2001 Caillat ..... 417/298

FOREIGN PATENT DOCUMENTS

JP 9-4548 * 1/1997
JP 2001-280253 10/2001

* cited by examiner

*Primary Examiner*—Michael Koczo, Jr.
(74) *Attorney, Agent, or Firm*—Staas & Halsey LLP

(57) ABSTRACT

A variable capacity rotary compressor to reduce an electric power loss thereof and includes a drive unit to generate a rotating force, a rotating shaft connected to the drive unit to rotate thereby, and a compressing cylinder through which the rotating shaft passes. A compressing chamber is defined in the compressing cylinder to compress refrigerant therein, with a first refrigerant inlet port provided at the compressing chamber to introduce the refrigerant into the compressing chamber. A capacity control unit controls an operation of the rotary compressor, so that the rotary compressor performs one of a normal-mode operation wherein the first refrigerant inlet port is maintained at an open state thereof, and the variable capacity-mode operation wherein the first refrigerant inlet port is periodically opened and closed.

27 Claims, 5 Drawing Sheets

VARIABLE CAPACITY ROTARY COMPRESSOR

CROSS-REFERENCE TO RELATED APPLICATION

This application claims the benefit of Korean Application No. 2003-9449, filed Feb. 14, 2003, in the Korean Intellectual Property Office, the disclosure of which is incorporated herein by reference.

BACKGROUND OF THE INVENTION

1. Field of the Invention

The present invention relates, in general, to variable capacity rotary compressors and, more particularly, to a variable capacity rotary compressor designed to reduce an electric power loss thereof.

2. Description of the Related Art

As is well known to those skilled in the art, variable capacity rotary compressors are devices which may be used in refrigeration systems, such as air conditioners or refrigerators operated with refrigerant continuously and repeatedly flowing through a refrigeration cycle which includes compression-condensation-expansion-evaporation, to compress the refrigerant to a high pressure, prior to discharging the compressed refrigerant to a condenser.

A conventional variable capacity rotary compressor includes a drive unit and a compressing unit, both of which being installed in a hermetic casing. The drive unit generates a rotating force, and the compressing unit compresses the refrigerant by using the rotating force of the drive unit. A rotating shaft is axially arranged in the hermetic casing such that the rotating shaft rotates by the rotating force of the drive unit, and transmits the rotating force to the compressing unit.

The compressing unit includes a compressing chamber, and a roller rotatably set in the compressing chamber. The roller of the compressing unit eccentrically rotates in the compressing chamber by the rotating force of the rotating shaft, thus compressing the refrigerant in the compressing chamber.

The conventional variable capacity rotary compressor includes a refrigerant inlet pipe which feeds the refrigerant into the compressing chamber while allowing the rotary compressor to compress the refrigerant while being controlled in a capacity thereof. An inlet pipe control valve is provided at the refrigerant inlet pipe to open or to close the refrigerant inlet pipe, as desired. When the inlet pipe control valve closes the refrigerant inlet pipe, an introduction of the refrigerant into the compressing chamber is stopped, so that the capacity of the rotary compressor is variably controlled.

However, when the drive unit is operated without the refrigerant being fed into the compressing chamber, the roller of the compressing unit rotates in the compressing chamber while compressing no refrigerant, such that electric power is undesirably wasted by the conventional variable capacity rotary compressor. Further, a negative pressure is generated in the compressing chamber to disturb a rotation of the rotating shaft, so that the negative pressure increases a loss of electric power of the conventional variable capacity rotary compressor.

SUMMARY OF THE INVENTION

Accordingly, it is an aspect of the present invention to provide a variable capacity rotary compressor which reduces a loss of electric power.

Additional aspects and/or advantages of the invention will be set forth in part in the description which follows and, in part, will be obvious from the description, or may be learned by practice of the invention.

The above and/or other aspects are achieved by a variable capacity rotary compressor, including a casing to form an appearance of the variable capacity rotary compressor, a drive unit to generate a rotating force, a rotating shaft connected at a first end thereof to the drive unit and rotated by the rotating force transmitted from the drive unit to the rotating shaft, a compressing cylinder through which a second end of the rotating shaft passes, a compressing chamber defined in the compressing cylinder to compress refrigerant therein with a first refrigerant inlet port provided at a predetermined portion of the compressing chamber to introduce the refrigerant into the compressing chamber, and a capacity control unit to control an operation of the variable capacity rotary compressor so as to allow the variable capacity rotary compressor to perform one of a normal-mode operation in which the first refrigerant inlet port is maintained in an open state thereof, and a variable capacity-mode operation wherein the first refrigerant inlet port is periodically opened and closed.

In the variable capacity rotary compressor, the capacity control unit includes a capacity control member installed to rotate along with the rotating shaft while being axially moved along the rotating shaft in either a first direction or a second direction, thus allowing the rotary compressor to perform one of the normal-mode operation and the variable capacity-mode operation.

The capacity control unit further includes a capacity control cylinder arranged in the variable capacity rotary compressor while being axially aligned with the compressing cylinder, a capacity control chamber defined in the capacity control cylinder so as to receive the capacity control member therein with a second refrigerant inlet port provided at a predetermined portion of the capacity control chamber to introduce the refrigerant into the capacity control chamber, and a partition plate to partition the capacity control chamber from the compressing chamber with the first refrigerant inlet port provided at a predetermined portion of the partition plate.

The capacity control member has a cylindrical shape, with a communicating depression being formed along a circumferential surface of the capacity control member within a predetermined range, thus allowing the first and second refrigerant inlet ports to be periodically opened and to communicate with each other during the variable capacity-mode operation.

The variable capacity rotary compressor further includes a three-way valve to feed one of the refrigerant under a high pressure and the refrigerant under a low pressure into the capacity control chamber, thus allowing the capacity control member to be axially moved along the rotating shaft in either a first direction or a second direction within the capacity control chamber according to the high pressure or the low pressure of the refrigerant fed into the capacity control chamber.

In the variable capacity rotary compressor, a refrigerant outlet pipe is connected to the casing so as to discharge the compressed refrigerant from the casing to an outside, a refrigerant inlet pipe is connected to the second refrigerant inlet port so as to introduce the refrigerant to be compressed into the casing, and the three-way valve is connected to a high-pressure refrigerant supply pipe branching from the refrigerant outlet pipe, a low-pressure refrigerant supply pipe branching from the refrigerant inlet pipe, and a capacity control pipe extending to the capacity control chamber, so that the three-way valve feeds one of the refrigerant under the high pressure fed through a high-pressure refrigerant supply pipe and the refrigerant under the low pressure fed through the low-pressure refrigerant supply pipe into the capacity control chamber through the capacity control pipe, thus allowing the capacity control member to be axially moved along the rotating shaft in either a first direction or a second direction within the capacity control chamber according to the high pressure or the low pressure of the refrigerant feed into the capacity control chamber.

The variable capacity rotary compressor further includes a shaft hole formed in the capacity control member so as to allow the rotating shaft to pass through the capacity control member, with a guide groove axially formed along an inner surface of the shaft hole so as to transmit the rotating force of the rotating shaft to the capacity control member, and a guide rib axially formed along an outer surface of the rotating shaft so as to engage with the guide groove of the capacity control member.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
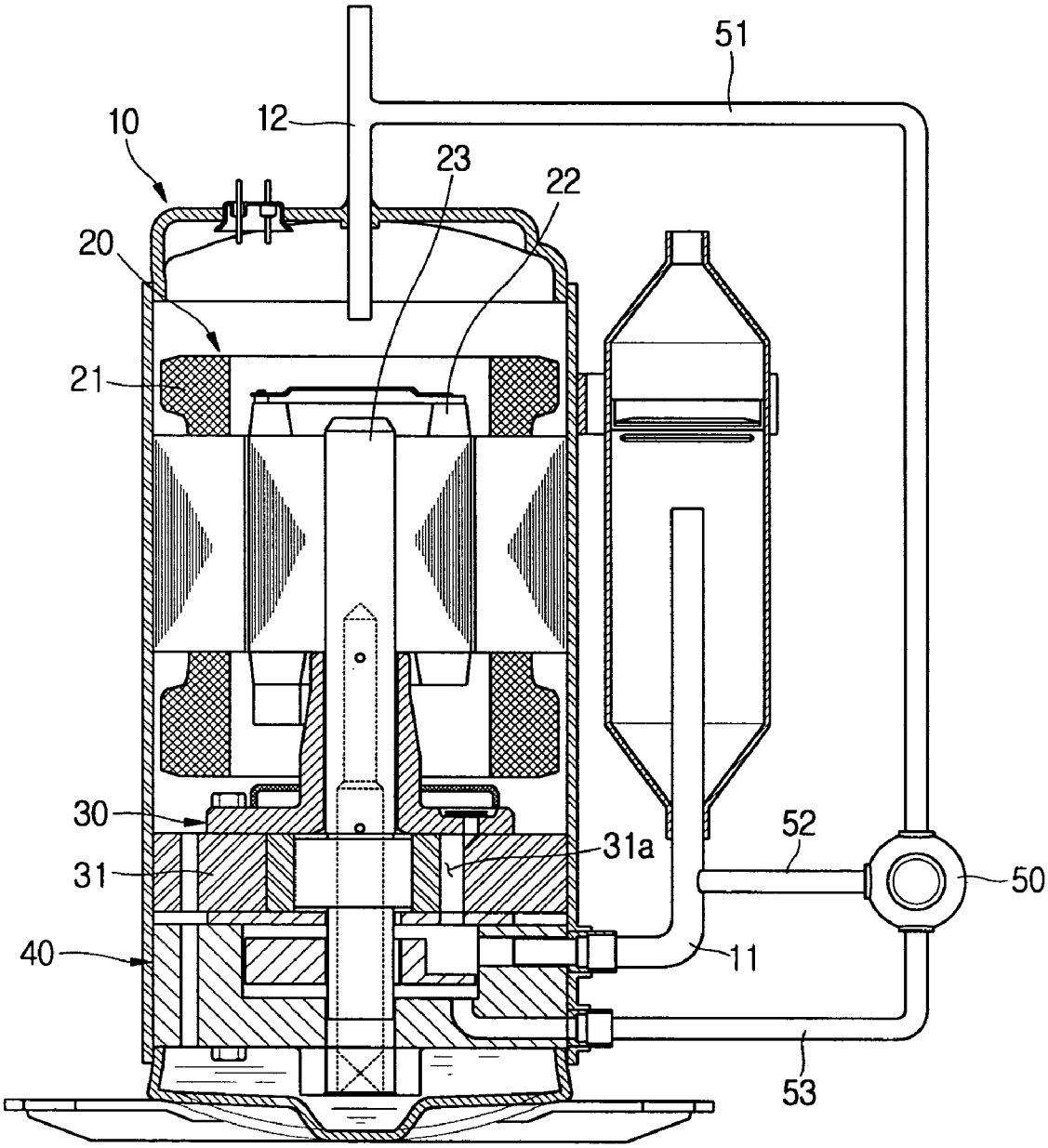
FIG. 1 is a sectional view of a variable capacity rotary compressor, according to an embodiment of the present invention.

Reference will now be made in detail to the present preferred embodiment of the present invention, examples of which are illustrated in the accompanying drawings, wherein like reference numerals refer to like elements throughout. The embodiments are described below in order to explain the present invention by referring to the figures.

Figure 2:
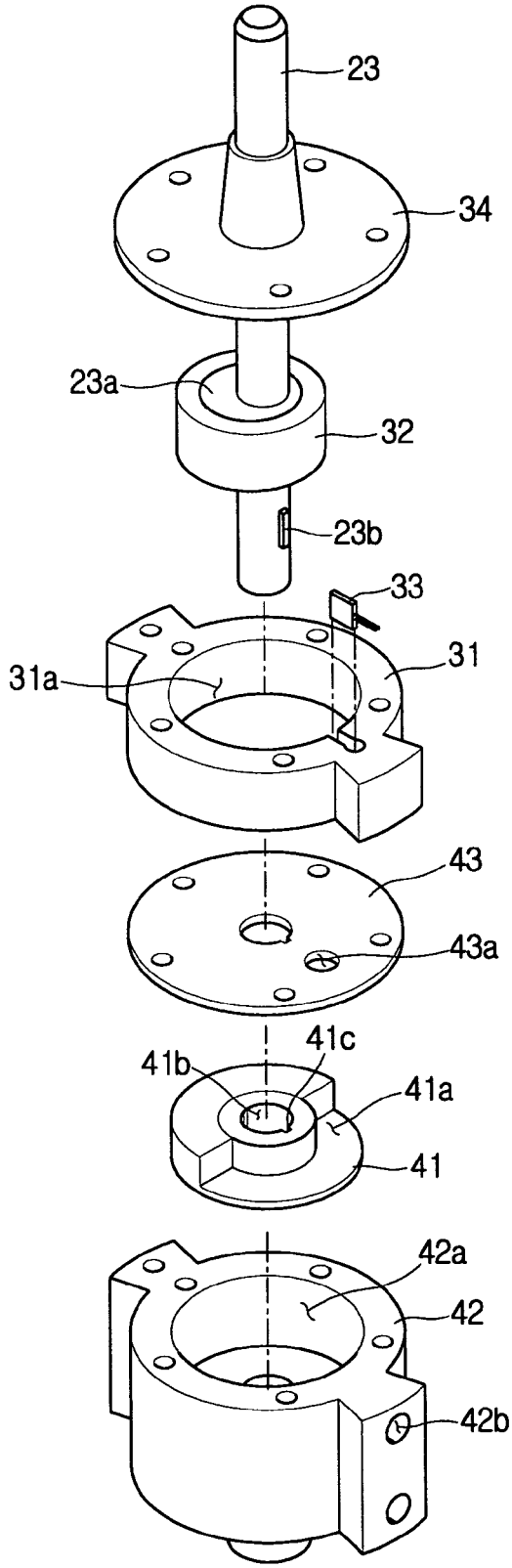
FIG. 2 is an exploded perspective view of a compressing unit and a capacity control unit of the variable capacity rotary compressor according to the embodiment of the present invention.

As shown in FIGS. 1 and 2, a variable capacity rotary compressor, according to an embodiment of the present invention, includes a hermetic casing 10, with a drive unit 20 and a compressing unit 30 installed in the hermetic casing 10. The drive unit 20 generates a rotating force when an electric current is applied to the drive unit 20. The compressing unit 30 compresses refrigerant using the rotating force of the drive unit 20 while intaking, compressing and discharging the refrigerant.

The hermetic casing 10 forms an external appearance of the variable capacity rotary compressor, with a refrigerant inlet pipe 11 connected to a lower portion of the hermetic casing 10 so as to introduce the refrigerant into the hermetic casing 10 and a refrigerant outlet pipe 12 connected to an upper end of the hermetic casing 10 so as to discharge the compressed refrigerant from the hermetic casing 10.

The drive unit 20 includes a stator 21, a rotor 22 and a rotating shaft 23. The stator 21 forms an electromagnetic field when the electric current is applied to the stator 21. The rotor 22 is rotatably and concentrically set in the stator 21, and rotating the electromagnetic field. The rotating shaft 23 is a longitudinal shaft having a circular cross-section. The rotating shaft 23 is connected to the rotor 22 at a first end thereof, and passes at a second end thereof through the compressing unit 30. The rotating shaft 23 rotates along with the rotor 22 to transmit the rotating force of the rotor 22 to the compressing unit 30.

The compressing unit 30, which operates using the rotating force of the drive unit 20 transmitted thereto through the rotating shaft 23, includes a compressing cylinder 31 defining a compressing chamber 31 *a* therein to compress the refrigerant. A roller 32 is set in the compressing chamber 31 *a* while fitting over an eccentric part 23*a* of the rotating shaft 23. The roller 32 is eccentrically rotated in the compressing chamber 31*a* by the rotating force of the rotating shaft 23, and compresses the refrigerant in the compressing chamber 31*a*. A vane 33 is installed at an inner surface of the compressing cylinder 31 so as to be movable in a radial direction, with an inside end of the vane 33 movably contacting with an outer surface of the roller 32, so that the vane 33 divides the compressing chamber 31*a* into two variable chamber parts. The two variable chamber parts include a suction chamber part into which the refrigerant is sucked and a compressing chamber part in which the refrigerant is compressed.

An upper flange 34 covers an upper end of the compressing cylinder 31.

The variable capacity rotary compressor includes a capacity control unit 40 which controls a capacity of the variable capacity rotary compressor, as desired.

The capacity control unit 40 controls an amount of the refrigerant introduced into the compressing chamber 31*a* so as to control the capacity of the variable capacity rotary compressor. The capacity control unit 40 allows the variable capacity rotary compressor to selectively perform a normal-mode operation or a variable capacity-mode operation. In the normal-mode operation, a first refrigerant inlet port 43*a*, provided at a predetermined portion of the compressing chamber 31*a*, is maintained at an open state thereof to continuously introduce the refrigerant into the compressing chamber 31*a*. In the variable capacity-mode operation, the first refrigerant inlet port 43*a* is periodically opened and closed so as to periodically stop the introduction of the refrigerant into the compressing chamber 31*a*.

The capacity control unit 40 includes a capacity control member 41, a capacity control cylinder 42, and a partition plate 43. The capacity control member 41 is movably fitted over the rotating shaft 23, so that the capacity control member 41 is rotated along with the rotating shaft 23 by the rotating force of the rotating shaft 23 while being axially moved along the rotating shaft 23 according to a pressure level of the refrigerant introduced into the capacity control unit 40. The capacity control cylinder 42 is arranged in the rotary compressor so as to be axially aligned with the compressing cylinder 31, and defines a capacity control chamber 42*a* therein to receive the capacity control member 41. The partition plate 43 is arranged between the compressing cylinder 31 and the capacity control cylinder 42 to partition the capacity control chamber 42*a* from the compressing chamber 31*a*.

A second refrigerant inlet port 42*b* is formed at a sidewall of the capacity control cylinder 42, and is connected to the refrigerant inlet pipe 11 to introduce the refrigerant into the capacity control chamber 42*a*. Further, the first refrigerant inlet port 43*a* is formed at the partition plate 43 so as to introduce the refrigerant from the capacity control chamber 42*a* into the compressing chamber 31*a*. Therefore, the refrigerant from the refrigerant inlet pipe 11 flows into the capacity control chamber 42*a* through the second refrigerant inlet port 42*b*, and, thereafter, flows into the compressing chamber 31*a* through the first refrigerant inlet port 43*a*.

The capacity control member 41 has a cylindrical shape, and is movably fitted over the rotating shaft 23 inside the capacity control chamber 42*a* so as to rotate along with the rotating shaft 23 while being axially moved along the rotating shaft 23. That is, the capacity control member 41 is rotated and axially moved within the capacity control chamber 42*a* in response to the refrigerant under a high pressure or a low pressure being introduced into the capacity control chamber 42*a* to change the operational mode of the variable capacity rotary compressor between the normal mode and the variable capacity mode, as desired. The capacity control member 41, which is cylindrical, is horizontally stepped to form a communicating depression 41*a* at a predetermined portion thereof. The first and second refrigerant inlet ports 43*a* and 42*b* selectively communicate with each other through the communicating depression 41*a* in response to a rotation angle of the capacity control member 41 during the variable capacity-mode operation, so that the refrigerant selectively flows from the second refrigerant inlet port 42*b* to the first refrigerant inlet port 43*a*. The communicating depression 41*a* is formed along a circumferential surface of the capacity control member 41 to selectively open the first and second refrigerant inlet ports 43*a* and 42*b* and to allow the first and second refrigerant inlet ports 43*a* and 42*b* to communicate with each other, in accordance with the rotation angle of the capacity control member 41. The communicating depression 41*a* may be formed along the circumferential surface of the capacity control member 41 within an angular range of of about 180°, so that the capacity control member 41 during the variable capacity-mode operation of the variable capacity rotary compressor reduces an amount of the sucked refrigerant to about a half of the amount of the sucked refrigerant in a case of the normal-mode operation of the variable capacity rotary compressor. That is, the capacity control member 41 periodically opens and closes the first and second refrigerant inlet ports 43*a* and 42*b* with each 180° rotation of the capacity control member 41, which rotates along with the rotating shaft 23.

Figure 3:
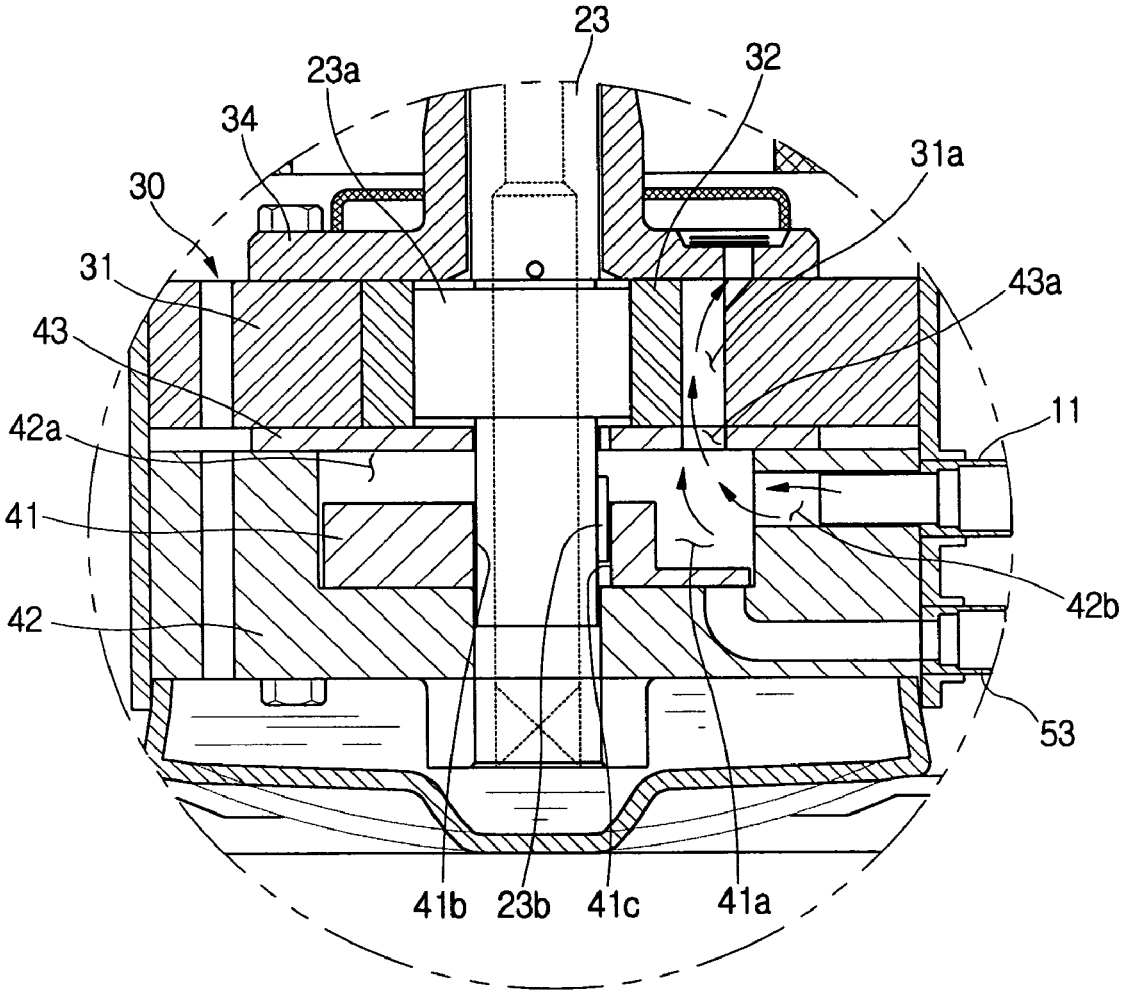
FIG. 3 is a partial sectional view of the variable capacity rotary compressor of FIG. 1, during a normal-mode operation thereof.
Figure 4:
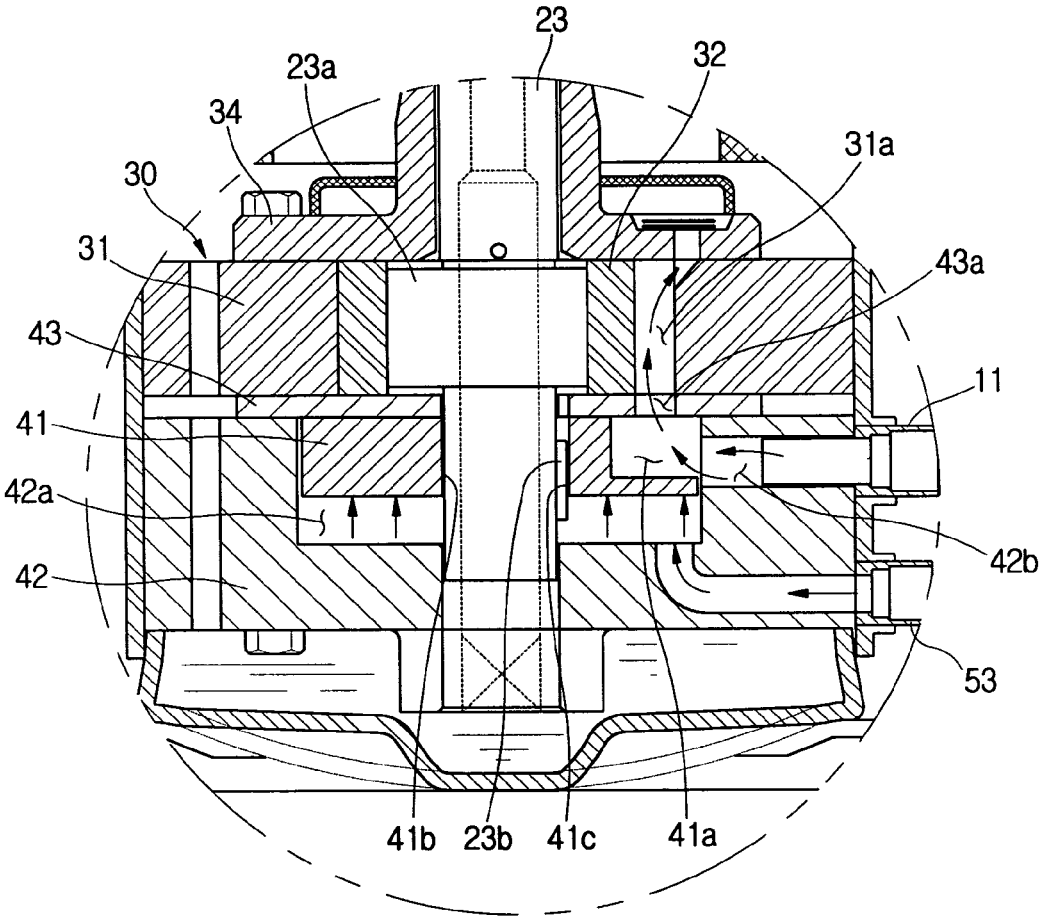
FIG. 4 is a partial sectional view of the variable capacity rotary compressor of FIG. 1, when two refrigerant inlet ports are opened and communicate with each other during a variable capacity-mode operation of the rotary compressor.
Figure 5:
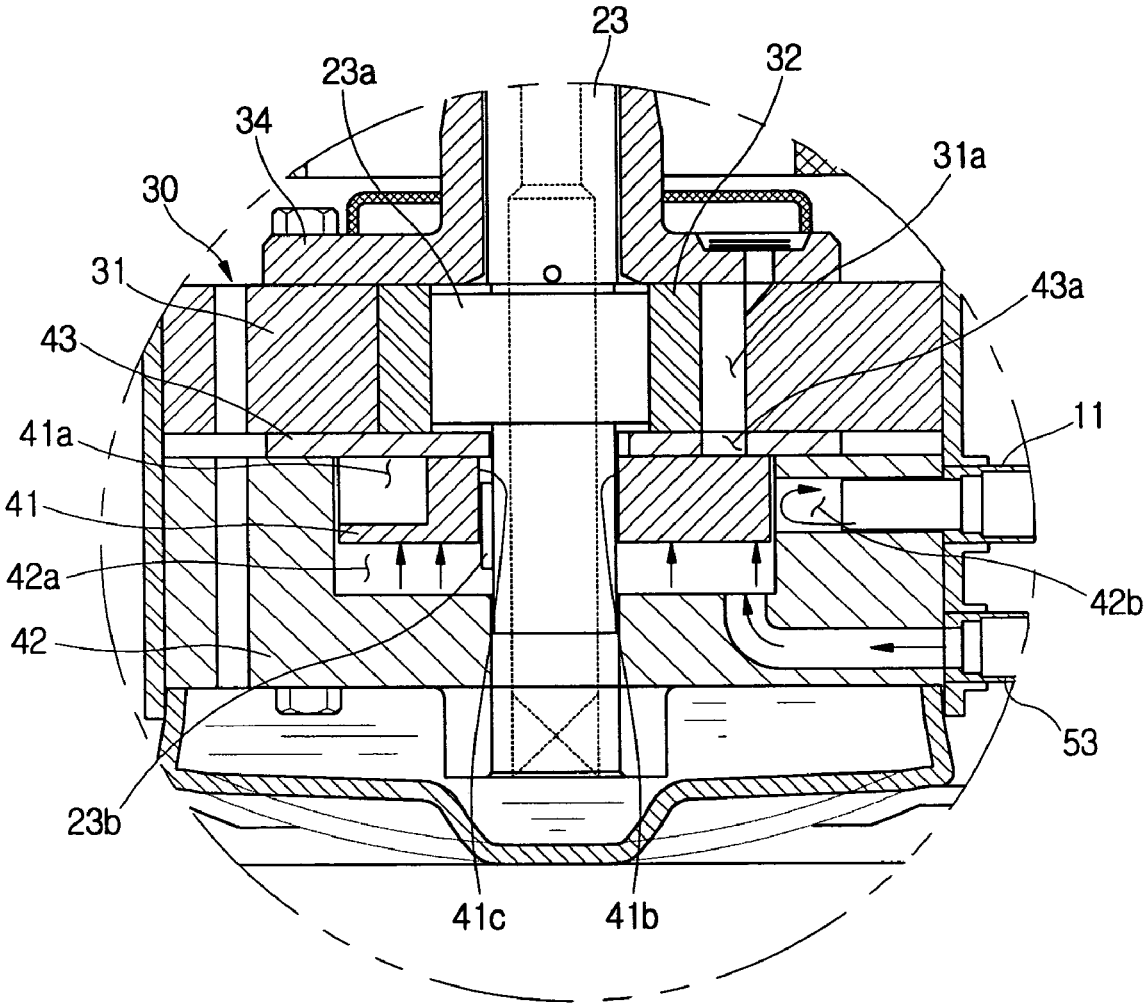
FIG. 5 is a partial sectional view of the variable capacity rotary compressor of FIG. 1, when the two refrigerant inlet ports are closed during the variable capacity-mode operation of the rotary compressor.

In the variable capacity rotary compressor, the capacity control member 41 is rotated at a position spaced apart from the partition plate 43 by a predetermined gap, as shown in FIG. 3, when the refrigerant under the low pressure is introduced into the capacity control chamber 42*a*. In such a case, the first and second refrigerant inlet ports 43*a* and 42*b* communicate with each other through the predetermined gap between the capacity control member 41 and the partition plate 43, such that the refrigerant is continuously fed into the compressing chamber 31*a*. The variable capacity rotary compressor in the above state is operated in the normal mode. However, when the refrigerant under the high pressure is introduced into the capacity control chamber 42*a*, the capacity control member 41 is axially moved upwards along the rotating shaft 23 while being rotated along with the rotating shaft 23 to reach an uppermost position (i.e., just under/adjacent to the partition plate 43). At the uppermost position, the capacity control member 41 is rotated along with the rotating shaft 23 to allow the first and second refrigerant inlet ports 43*a* and 42*b* to selectively communicate with each other through the communicating depression 41*a*, as shown in FIGS. 4 and 5. Therefore, the refrigerant is fed into the compressing chamber 31*a* only when the first and second refrigerant inlet ports 43*a* and 42*b* communicate with each other, so that the variable capacity rotary compressor is operated in the variable capacity mode.

A shaft hole 41*b* is formed along a central axis of the capacity control member 41 so as to receive the rotating shaft 23 therein. A guide groove 41*c* is axially formed along an inner surface of the shaft hole 41*b* so as to transmit the rotating force of the rotating shaft 23 to the capacity control member 41 while allowing the capacity control member 41 to be axially moved along the rotating shaft 23 in either a first direction or a second direction within the capacity control chamber 42*a* according to the pressure level of the refrigerant feed into the capacity control chamber 42*a*.

To movably engage with the guide groove 41*c* of the capacity control member 41, a guide rib 23*b* is axially formed along an outer surface of the rotating shaft 23 at a predetermined portion thereof. Due to the movable engagement of the guide rib 23*b* of the rotating shaft 23 with the guide groove 41*c* of the capacity control member, the rotating force of the rotating shaft 23 is transmitted to the capacity control member 41, and the capacity control member 41 is allowed to axially move along the rotating shaft 23 in either a first direction or a second direction within the capacity control chamber 42*a* according to the pressure level of the refrigerant feed into the capacity control chamber 42*a*.

The variable capacity rotary compressor includes a three-way valve 50 which selectively feeds the refrigerant under the high pressure or the refrigerant under the low pressure into the capacity control chamber 42*a*, to allow the capacity control member 41 to axially move within the capacity control chamber 42*a*.

That is, the three-way valve 50 selectively introduces the refrigerant under the high pressure or the refrigerant under the low pressure into the capacity control chamber 42*a* so as to allow the capacity control member 41 to axially move along the rotating shaft 23. The three-way valve 50 is connected to a high-pressure refrigerant supply pipe 51, a low-pressure refrigerant supply pipe 52, and a capacity control pipe 53. The high-pressure refrigerant supply pipe 51 branches from the refrigerant outlet pipe 12, and supplies the refrigerant under the high pressure to the three-way valve 50. The low-pressure refrigerant supply pipe 52 branches from the refrigerant inlet pipe 11, and supplies the refrigerant under the low pressure to the three-way valve 50. The capacity control pipe 53 guides the refrigerant under the high pressure or the low pressure from the three-way valve 50 into the capacity control chamber 42*a*.

During the normal-mode operation of the variable capacity rotary compressor, the three-way valve 50 opens the low-pressure refrigerant supply pipe 52 and the capacity control pipe 53, so that the refrigerant under the low pressure is fed into the capacity control chamber 42*a* through the capacity control pipe 53. In this case, the capacity control member 41 moves axially downward along the rotating shaft 23, to be placed at the position spaced apart from the partition plate 43 by the predetermined gap, as shown in FIG. 3. The first and second refrigerant inlet ports 43*a* and 42*b* are opened, and communicate with each other through the predetermined gap between the capacity control member 41 and the partition plate 43, so that the refrigerant is continuously fed into the compressing chamber 31*a*. During the variable capacity-mode operation of the variable capacity rotary compressor, the three-way valve 50 opens the high-pressure refrigerant supply pipe 51 and the capacity control pipe 53, so that the refrigerant under the high pressure is fed into the capacity control chamber 42*a* through the capacity control pipe 53. In this case, the capacity control member 41 axially moves upward along the rotating shaft 23 so as to reach the uppermost position at which the capacity control member 41 comes into contact with the partition plate 43. At the uppermost position, the capacity control member 41 is rotated along with the rotating shaft 23 to allow the first and second refrigerant inlet ports 43*a* and 42*b* to selectively communicate with each other through the communicating depression 41*a* of the capacity control member 41, as shown in FIGS. 4 and 5.

The operational effect of the variable capacity rotary compressor will be described herein below, with reference to the accompanying drawings.

When the variable capacity rotary compressor is operated in the normal mode, the three-way valve 50 receives the refrigerant under the low pressure from the low-pressure refrigerant supply pipe 52, and feeds the refrigerant under the low pressure into the capacity control chamber 42*a* through the capacity control pipe 53.

In this case, the capacity control member 41 inside of the capacity control chamber 42*a* is placed at the position spaced apart from the partition plate 43 by the predetermined gap, as shown in FIG. 3. The first and second refrigerant inlet ports 43*a* and 42*b* communicate with each other through the predetermined gap between the capacity control member 41 and the partition plate 43, so that the refrigerant is continuously fed into the compressing chamber 31*a*, regardless of a rotation angle of the capacity control member 41.

However, when the variable capacity rotary compressor is operated in the variable capacity mode, the three-way valve 50 receives the refrigerant under the high pressure from the high-pressure refrigerant supply pipe 51, and feeds the refrigerant under the high pressure into the capacity control chamber 42*a* through the capacity control pipe 53.

The capacity control member 41 inside of the capacity control chamber 42*a* moves axially upward along the rotating shaft 23 to the partition plate 43. In this case, the rotating force of the rotating shaft 23 is transmitted to the capacity control member 41 through both the guide rib 23*b* of the rotating shaft 23 and the guide groove 41*c* of the capacity control member 41. The capacity control member 41 is rotated along with the rotating shaft 23. During the rotating action of the capacity control member 41, a port communicating state occurs in which the first and second refrigerant inlet ports 43*a* and 42*b* communicate with each other, as shown in FIG. 4. Further, a port closed state occurs in which the first and second refrigerant inlet ports 43*a* and 42*b* are closed, as shown in FIG. 5. That is, the first and second refrigerant inlet ports 43*a* and 42*b* are periodically and alternately opened and closed in accordance with the rotation angle of the capacity control member 41. Therefore, the introduction of the refrigerant into the compressing chamber 31*a* in the variable capacity-mode operation is periodically stopped, so that a reduced amount of the refrigerant is steadily fed into the compressing chamber 31*a*. The variable capacity rotary compressor during the variable capacity-mode operation compresses and discharges a smaller amount of the refrigerant, in comparison to the normal-mode operation.

As is apparent from the above description, the present invention provides a variable capacity rotary compressor. During a variable capacity-mode operation of the variable capacity rotary compressor, a passage between first and second refrigerant inlet ports is periodically and alternately opened and closed in accordance with a rotation angle of a capacity control member. A smaller amount of refrigerant is thus fed into a compressing chamber during the variable capacity-mode operation in comparison to the normal-mode operation, so as to reduce an electric power loss of the variable capacity rotary compressor. Further, the variable capacity rotary compressor does not generate a negative pressure in the compressing chamber, so as to prevent the electric power loss caused by the negative pressure from disturbing a rotation of a rotating shaft of the variable capacity compressor.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A variable capacity rotary compressor, comprising:

a casing to form an external appearance of the variable capacity rotary compressor;

a drive unit to generate a rotating force;

a rotating shaft connected at a first end thereof to the drive unit, and rotated by the rotating force transmitted from the drive unit to the rotating shaft;

a compressing cylinder through which a second end of the rotating shaft passes;

a compressing chamber defined in the compressing cylinder to compress refrigerant therein, with a first refrigerant inlet port provided at a predetermined portion of the compressing chamber to introduce the refrigerant into the compressing chamber; and a capacity control unit comprising the first refrigerant inlet port and controlling an operation of the variable capacity rotary compressor so as to allow the rotary compressor to perform one of a normal-mode operation wherein the first refrigerant inlet port is maintained at an open state thereof to continuously introduce the refrigerant into the compressing chamber, and of a variable capacity-mode operation wherein the first refrigerant inlet port is periodically opened and closed so as to periodically stop the introduction of the refrigerant into the compression chamber, wherein the capacity control unit further comprises a capacity control member installed to rotate along with the rotating shaft while moving axially along the rotating shaft to allow the rotary compressor to perform one of the normal-mode operation and of the variable capacity-mode operation.

2. The variable capacity rotary compressor according to claim 1, wherein the capacity control unit further comprises:

a capacity control cylinder arranged in the variable capacity rotary compressor while axially aligning with the compressing cylinder;

a capacity control chamber defined in the capacity control cylinder so as to receive the capacity control member therein, with a second refrigerant inlet port provided at a predetermined portion of the capacity control chamber to introduce the refrigerant into the capacity control chamber; and a partition plate to partition the capacity control chamber from the compressing chamber, with the first refrigerant inlet port provided at a predetermined portion of the partition plate.

3. The variable capacity rotary compressor according to claim 2, wherein the capacity control member has a cylindrical shape, and comprises:

a communicating depression formed along a circumferential surface of the capacity control member within a predetermined range to allow the first and second refrigerant inlet ports to be periodically opened and communicate with each other during the variable capacity-mode operation.

4. The variable capacity rotary compressor according to claim 1, further comprising:

a three-way valve to feed one of the refrigerant under a high pressure and the refrigerant under a low pressure into the capacity control chamber to allow the capacity control member to axially move in either a first direction or a second direction within the capacity control chamber in accordance with the refrigerant being feed into the capacity control chamber under the high pressure or the low pressure.

5. The variable capacity rotary compressor according to claim 4, further comprising:

a refrigerant outlet pipe connected to the casing so as to discharge the compressed refrigerant from the casing to an outside; and a refrigerant inlet pipe connected to the second refrigerant inlet port so as to introduce the refrigerant to be compressed into the casing;

a high-pressure refrigerant supply pipe branching from the refrigerant outlet pipe and connected to the three-way valve;

a low-pressure refrigerant supply pipe branching from the refrigerant inlet pipe and connected to the three-way valve; and a capacity control pipe extending to the capacity control chamber and connected to the three-way valve wherein the three-way valve feeds one of the refrigerant under the high pressure fed through the high-pressure refrigerant supply pipe and the refrigerant under the low pressure fed through the low-pressure refrigerant supply pipe into the capacity control chamber through the capacity control pipe to allow the capacity control member to axially move within the capacity control chamber.

6. The variable capacity rotary compressor according to claim 1, further comprising:

a guide groove;

a shaft hole formed in the capacity control member so as to allow the rotating shaft to pass through the capacity control member, with the guide groove axially formed along an inner surface of the shaft hole so as to transmit the rotating force of the rotating shaft to the capacity control member; and a guide rib axially formed along an outer surface of the rotating shaft so as to engage with the guide groove of the capacity control member.

7. A variable capacity rotary compressor, comprising:

a compression unit to compress refrigerant therein and including one inlet port provided thereat to introduce the refrigerant into the compression unit, the compression unit comprising a rotating shaft rotating in the compression unit and allowing a compression of the refrigerant; and a capacity control unit comprising the inlet port at a portion thereof and operating in a plurality of operational modes such that, in a first of the operational modes, the one inlet port is maintained in an open state, and, in a second of the operational modes, the one inlet port is alternately opened and closed according to a variable capacity of the variable capacity rotary compressors, wherein the capacity control unit further comprises a capacity control member rotating along with the rotating shaft while moving axially alone the rotating shaft to allow the variable capacity rotary compressor to operate in at least the first operational mode or second operational mode in accordance with the refrigerant being feed into the capacity control chamber unit at a selected pressure level.

8. The variable capacity rotary compressor according to claim 7, wherein the capacity control unit further comprises:

a capacity control chamber disposed to align with the compression unit so as to receive the capacity control member therein, with a further inlet port provided at a predetermined portion of the capacity control chamber to introduce the refrigerant into the capacity control chamber; and a partition to partition the capacity control chamber from the compression unit, with the one inlet port provided at a predetermined portion of the partition.

9. The variable capacity rotary compressor according to claim 8, wherein the capacity control member has a cylindrical shape, and comprises:

a depression formed along a surface of the capacity control member within a predetermined range to allow the one inlet port and the further inlet port to periodically open and communicate with each other during the second operational mode.

10. The variable capacity rotary compressor according to claim 8, further comprising:

a three-way valve to introduce the refrigerant under one of a high pressure and a low pressure into the capacity control chamber to allow the capacity control member to axially move within the capacity control chamber in accordance with the refrigerant being feed into the capacity control chamber under the high pressure or the low pressure.

11. The variable capacity rotary compressor according to claim 10, further comprising:

an outlet pipe to discharge the compressed refrigerant to an outside; and an inlet pipe connected to the further inlet port so as to introduce the refrigerant to be compressed into the compression unit;

a high-pressure supply pipe branching from the outlet pipe and connected to the three-way valve;

a low-pressure refrigerant supply pipe branching from the inlet pipe and connected to the three-way valve; and a capacity control pipe extending to the capacity control chamber and connected to the three-way valve, wherein the three-way valve feeds the refrigerant under one of the high pressure from the high-pressure supply pipe and the low pressure from the low-pressure supply pipe into the capacity control chamber through the capacity control pipe to allow the capacity control member to axially move within the capacity control chamber.

12. The variable capacity rotary compressor according to claim 7, further comprising:

a guide groove;

a shaft hole formed in the capacity control member so as to allow the rotating shaft to pass through the capacity control member, with the guide groove axially formed along an inner surface of the shaft hole so as to transmit a rotating force from the rotating shaft to the capacity control member; and a guide rib axially formed along an outer surface of the rotating shaft so as to engage with the guide groove of the capacity control member.

13. The variable capacity rotary compressor according to claim 7, wherein the compression unit further comprises:

a compressing cylinder defining a compressing chamber therein to compress the refrigerant;

the rotating shaft is rotatably disposed in the compressing chamber with an eccentric part to allow the compression of the refrigerant;

a roller fitted over the eccentric part of the rotating shaft, the roller being eccentrically rotated in the compressing chamber by the rotating shaft and compressing the refrigerant in the compressing chamber, and a vane disposed at an inner surface of the compressing cylinder to divide the compressing chamber into two chamber parts.

14. The variable capacity rotary compressor according to claim 13, wherein the two chamber parts comprises:

a suction chamber part into which the refrigerant is sucked and a compressing chamber part in which the refrigerant is compressed.

15. The variable capacity rotary compressor according to claim 7, wherein, in the second of the plural operational modes, the one inlet port is periodically opened and closed so as to periodically stop an introduction of the refrigerant into the compressing unit.

16. The variable capacity rotary compressor according to claim 7, wherein:

the capacity control member is movably fitted over the rotating shaft to axially move along a length of the rotating shaft according to the pressure level of the refrigerant introduced into the capacity control unit.

17. The variable capacity rotary compressor according to claim 16, wherein the capacity control member is both rotated and axially moved within the capacity control unit in response to the refrigerant under either a first pressure level or a second pressure level, different from the first pressure level, being introduced into the capacity control unit.

18. The variable capacity rotary compressor according to claim 17, one of the plural operational modes is selectable according to one of the first and second pressure levels introduced into the capacity control unit.

19. The variable capacity rotary compressor according to claim 8, wherein the capacity control member has a cylindrical shape and is stepped at a predetermined portion thereof.

20. The variable capacity rotary compressor according to claim 19, wherein the stepped portion of the capacity control member provides a flow path formed along a circumferential surface of the capacity control member to selectively open the one inlet port and the further inlet port and to allow the one inlet port and the further inlet port to communicate with each other, in accordance with a rotation angle of the capacity control member.

21. The variable capacity rotary compressor according to claim 19, wherein the stepped portion of the capacity control member provides a flow path defined thereby to allow the one inlet port and the further inlet port to communicate with each other, in accordance with a rotation angle of the capacity control member.

22. The variable capacity rotary compressor according to claim 21, wherein the stepped portion of the capacity control member provides is formed along a circumferential surface within an angular range of 180°.

23. The variable capacity rotary compressor according to claim 22, wherein a first amount of the refrigerant introduced into the compression unit during the second operational mode, is reduced compared to a second amount of the refrigerant introduced into the compression unit during the first operational mode.

24. The variable capacity rotary compressor according to claim 23, wherein the second amount of the refrigerant introduced into the compression unit is substantially half that of the first amount of the refrigerant introduced into the compression unit.

25. The variable capacity rotary compressor according to claim 17, further comprising:

a partition plate disposed between the capacity control unit and the compression unit to partition the capacity control unit and the compression unit, wherein the capacity control member is rotated at a position spaced apart from the partition plate by a predetermined gap, when the refrigerant under the first pressure level is introduced into the capacity control unit, and the capacity control member is axially moved toward the partition plate to be adjacent to and contacting with the partition plate, when the refrigerant under the second pressure level is introduced into the capacity control unit.

26. The variable capacity rotary compressor according to claim 25, further comprising:

a further inlet port provided at a predetermined portion of the capacity control unit to introduce the refrigerant into the capacity control unit; and wherein, when the capacity control member is spaced apart from the partition plate by a predetermined gap, the one inlet port and the further inlet port communicate with each other through the predetermined gap between the capacity control member and the partition plate such that the refrigerant is continuously fed into the compression unit.

27. The variable capacity rotary compressor according to claim 25, further comprising:

a further inlet port provided at a predetermined portion of the capacity control unit to introduce the refrigerant into the capacity control unit; and wherein, when the capacity control member is adjacent to and contacting with the partition plate the one inlet port and the further inlet port selectively communicate with each other according to a rotation angle of the capacity control member.

* * * * *

UNITED STATES PATENT AND TRADEMARK OFFICE

CERTIFICATE OF CORRECTION

PATENT NO. : 7,232,291 B2
APPLICATION NO. : 10/671597
DATED : June 19, 2007
INVENTOR(S) : Jae-Young Choi et al.

It is certified that error appears in the above-identified patent and that said Letters Patent is hereby corrected as shown below:

Column 10, Line 10-11, Claim 7 change “compressors,” to --compressor,--.

Column 10, Line 14, Claim 7 change “alone” to --along--.

Column 11, Line 38, Claim 16 change “wherein:” to --wherein--.

Signed and Sealed this

Sixth Day of November, 2007

JON W. DUDAS
*Director of the United States Patent and Trademark Office*